US010863877B2

(12) United States Patent
Mochita et al.

(10) Patent No.: US 10,863,877 B2
(45) Date of Patent: Dec. 15, 2020

(54) TOILET LID DEVICE

(71) Applicant: TOTO LTD., Kitakyushu (JP)

(72) Inventors: Masayuki Mochita, Kitakyushu (JP); Yukari Kawazu, Kitakyushu (JP); Megumi Hirayama, Kitakyushu (JP); Minoru Matsui, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/214,274

(22) Filed: Dec. 10, 2018

(65) Prior Publication Data

US 2019/0200819 A1 Jul. 4, 2019

(30) Foreign Application Priority Data

Dec. 28, 2017 (JP) ..... 2017-253959

(51) Int. Cl.
*A47K 13/14* (2006.01)
*E03D 9/08* (2006.01)
*A47K 13/12* (2006.01)

(52) U.S. Cl.
CPC ..... *A47K 13/14* (2013.01); *A47K 13/12* (2013.01); *E03D 9/08* (2013.01)

(58) Field of Classification Search
CPC ..... A47K 13/14; A47K 13/12; E03D 9/08
USPC ..... 4/234, 236
See application file for complete search history.

(56) References Cited

U.S. PATENT DOCUMENTS 4,246,666 A * 1/1981 Stansbury, Jr. ..... E03D 5/09 4/236
5,901,383 A 5/1999 Yanagawa
9,895,035 B2 * 2/2018 Kang ..... A47K 13/12
2007/0226883 A1 * 10/2007 Kaule ..... A47K 13/12 4/236
2013/0133131 A1 * 5/2013 Peng ..... A47K 13/302 4/237

(Continued)

FOREIGN PATENT DOCUMENTS

CN 301868130 S 3/2012
CN 202347617 U 7/2012
CN 105764394 A 7/2016

(Continued)

OTHER PUBLICATIONS

English translation of the Chinese Office Action issued in Chinese Patent Application No. 201811396628.2 dated Oct. 29, 2020.

*Primary Examiner* — Tuan N Nguyen
(74) *Attorney, Agent, or Firm* — Pearne & Gordon LLP

(57) ABSTRACT

According to one embodiment, a toilet lid device includes a casing, a toilet seat and a toilet lid rotatably supported with respect to the casing, and a first support portion and a second support portion rotatably supporting the toilet lid with respect to the casing. The casing is provided between left and right side surfaces of the casing. The casing includes first and second grooves. The first and second grooves are not exposed on the left and right side surfaces. The toilet lid includes first and second hinge portions. The first hinge portion is connected to the first support portion in the first groove, and the second hinge portion is connected to the second support portion in the second groove. Each of the left and right side surfaces of the casing does not include a step backward a rear end of the toilet seat.

8 Claims, 10 Drawing Sheets

(56) References Cited

U.S. PATENT DOCUMENTS

| | | | |
|---|---|---|---|
| 2016/0296085 | A1 | 10/2016 | Kang et al. |
| 2019/0063054 | A1 | 2/2019 | Luettgen et al. |

FOREIGN PATENT DOCUMENTS

| | | | |
|---|---|---|---|
| CN | 108603368 | A | 9/2018 |
| JP | 2008-035973 | A | 2/2008 |
| JP | 2008-148869 | A | 7/2008 |
| JP | 1370792 | S | 10/2009 |
| JP | 2011-200508 | A | 10/2011 |
| WO | 2017/035246 | A1 | 3/2017 |

* cited by examiner

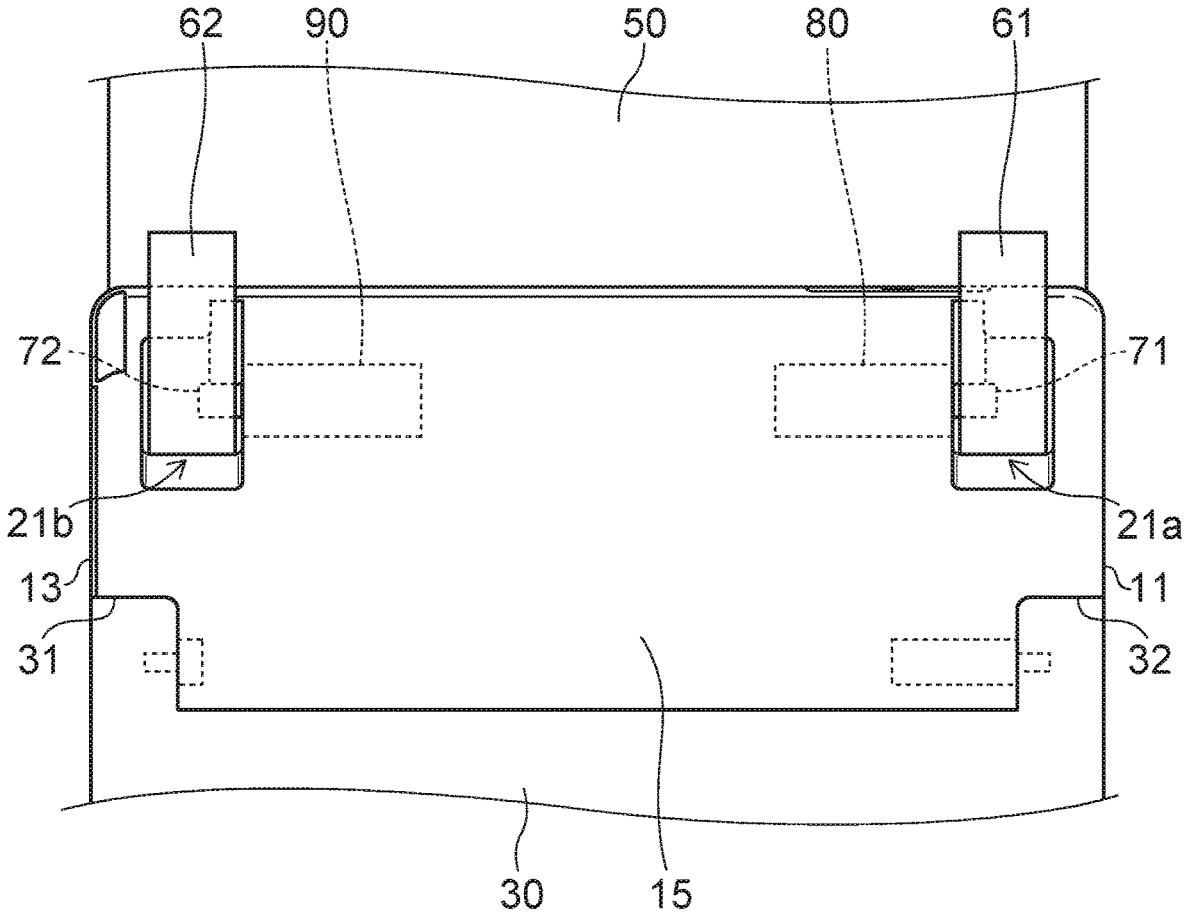
FIG. 4
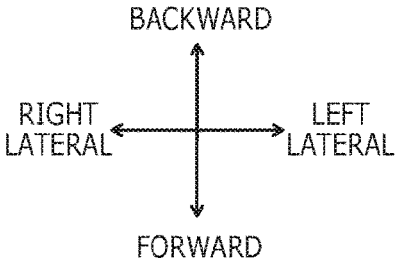

TOILET LID DEVICE

CROSS-REFERENCE TO RELATED APPLICATIONS

This application is based upon and claims the benefit of priority from Japanese Patent Application No. 2017-253959, filed on Dec. 28, 2017; the entire contents of which are incorporated herein by reference.

FIELD

Embodiments described herein relate generally to a toilet lid device.

BACKGROUND

Conventionally, a toile lid device including a toilet seat and a toile lid rotatably attached to a casing has been known. In a state of the toilet lid closed, a lower surface of the toilet lid covers an upper surface of the casing and an upper surface of the toilet seat. The toilet lid can suppress dust from accumulating on the upper surface of the casing and the upper surface of the toilet seat.

SUMMARY

According to the embodiment, a toilet lid device includes a casing, a toilet seat and a toilet lid rotatably supported with respect to the casing, and a first support portion and a second support portion rotatably supporting the toilet lid with respect to the casing. The casing is provided between a left side surface and a right side surface of the casing. The casing includes a first groove and a second groove. The first groove and the second groove are not exposed on the left side surface and the right side surface. The toilet lid includes a first hinge portion and a second hinge portion. The first hinge portion is connected to the first support portion in the first groove, and the second hinge portion is connected to the second support portion in the second groove. Each of the left side surface and the right side surface of the casing does not include a step backward a rear end of the toilet seat.

BRIEF DESCRIPTION OF THE DRAWINGS

FIG. 4 is a plan view illustrating a portion of the toilet lid device according to the embodiment;

DETAILED DESCRIPTION

Figure 1:
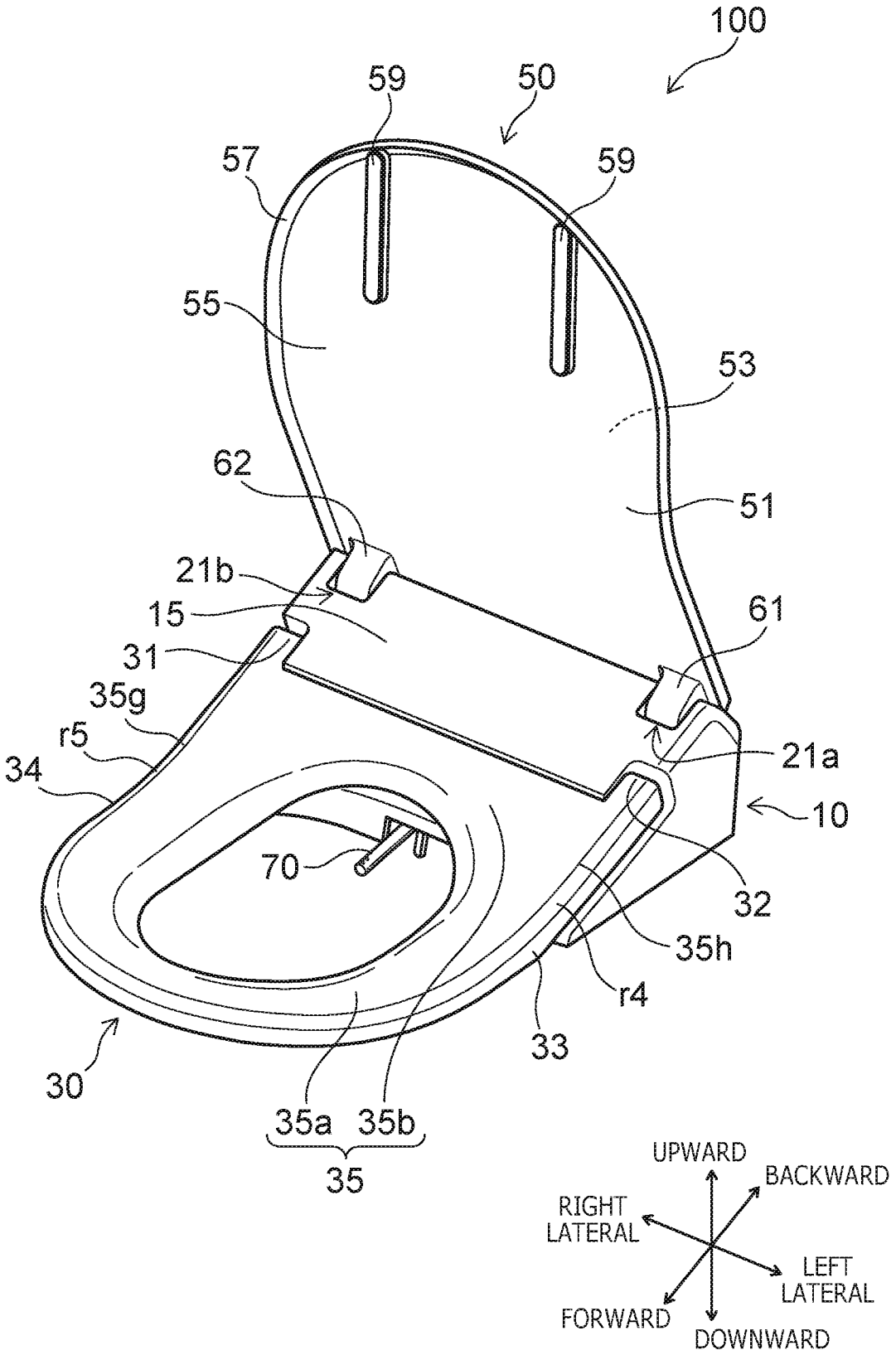
FIG. 1 is a perspective view illustrating a toile lid device according to an embodiment.

The first invention relates to a toilet lid device. The toilet lid device includes a casing, a toilet seat and a toilet lid rotatably supported with respect to the casing, and a first support portion and a second support portion rotatably supporting the toilet lid with respect to the casing. The casing is provided between a left side surface and a right side surface of the casing, and includes a first groove and a second groove. The first groove and the second groove are not exposed on the left side surface and the right side surface. The toilet lid includes a first hinge portion and a second hinge portion. The first hinge portion is connected to the first support portion in the first groove, and the second hinge portion is connected to the second support portion in the second groove. Each of the left side surface and the right side surface of the casing does not include a step backward a rear end of the toilet seat.

According to the toilet lid device, since each of the left side surface and the right side surface of the casing does not include a step backward a rear end of the toilet seat, the sanitary property on the left side surface and the right side surface of the casing can be improved. For example, the dust can be suppressed from accumulating on the left side surface and the right side surface of the casing. Also, the wiping cleaning on the left side surface and the right side surface of the casing becomes easy.

Since the toilet lid is supported at the first, second hinge portions, balance in a left-right direction can be improved in comparison with the single hinge portion.

The second invention is the toilet lid device in the first invention, wherein the toilet lid exposes the left side surface and the right side surface of the casing in a state of the toilet lid closed, and covers an upper surface of the casing from a right side end to a left side end.

According to the toilet lid device, since the toilet lid covers the upper surface of the casing from the right side end to the left side end in the state of the toilet lid closed, the dust can be suppressed from accumulating on the upper surface of the casing. The cleaning of the left side surface and the right side surface of the casing is easy to be made with the toilet lid closed by exposing the left side surface and the right side surface of the casing from the toilet lid in the state of the toilet lid closed.

Third invention is the toilet lid device in the second invention, wherein the toilet lid exposes a left side surface and a right side surface of the toilet seat in a state of the toilet lid closed, and covers an upper surface of the toilet seat from a right side end to a left end side.

According to the toilet lid device, since the left side surface and the right side surface of the toilet seat are not covered with the toilet lid and are exposed in the state of the toilet lid closed, a lateral width of the toilet seat can be broad. Thereby, a range covered with the toilet seat from upward can be broad, and the dust can be suppressed from accumulating on the casing.

The fourth invention is the toilet lid device in the third invention, wherein the toilet lid covers the entire upper surface of the casing in a state of the toilet lid closed.

According to the toilet lid device, the toilet lid covers the entire upper surface of the casing in the state of the toilet lid closed, and the dust can be suppressed from accumulating on the casing. The dust can also be suppressed from accumulating between the toilet seat and the casing.

The fifth invention is the toilet lid device in the fourth invention, wherein in a state of the toilet lid opened, an upper surface of the first hinge portion is flush with the upper surface of the casing.

According to the toilet device, since unevenness between the upper surface of the first hinge portion and the upper surface of the casing is small in the state of the toilet lid opened, cleanliness can be improved. For example, the wiping cleaning of the upper surface of the casing becomes easy.

The sixth invention is the toilet lid device in the fourth invention, wherein in a state of the toilet lid opened, a distance between the forward end of the first hinge portion and a forward end of the first groove is longer than a distance between a lateral end of the first hinge portion and a lateral end of the first groove.

According to the toilet lid device, a gap between a forward end of the first hinge portion and a forward end of the first groove is relatively broad in the state of the toilet lid opened. Thereby, a dust cloth or the like can be put into the first groove from the gap between the forward end of the first hinge portion and the forward end of the first groove in the state of the toilet lid opened. For that reason, the cleaning in the first groove becomes easy.

The seventh invention is the toilet lid device in the fourth invention, wherein a recess exposing on a rear surface side of the casing is provided on a lower surface of the first groove.

According to the toilet lid device, the cleaning in the first groove can be made from the recess, and the cleanliness can be improved.

Various embodiments will be described hereinafter with reference to the accompanying drawings. In the drawings, the same reference numbers are applied to the same elements and the detailed description will be omitted as appropriate.

FIG. 1 is a perspective view illustrating a toile lid device according to an embodiment.

As shown in FIG. 1, a toilet lid device 100 according to the embodiment includes a casing 10, a toilet seat 30 on which a user sits, and a toilet lid 50. Each of the toilet seat 30 and the toile lid 50 is rotatably supported with respect to the casing 10. In other word, each of the toilet seat 30 and the toile lid 50 is pivoted for opening and closing. A state of FIG. 1 is a state of the toilet seat 30 closed (lowered state) and a state of the toilet lid 50 opened (raised). The toilet lid 50 covers upper surfaces of the casing 10 and the toilet seat 30 from upward (see FIG. 5).

A body cleaning function portion or the like is installed inside the casing 10, which realizes cleaning of a human body private part ("bottom" or the like) of the user sitting on the toilet seat 30. For example, a control circuit or the like controlling a cleaning nozzle 70 or operation of the cleaning nozzle 70 is provided inside the casing 10. When the user is sitting on the toilet seat 30, the cleaning nozzle 70 discharges wash water toward the private part of the user in a state where the casing 10 is advanced from the inside to forward. The casing 10 may be provided appropriately with various mechanisms such as "a warm air drying unit", "a deodorizing unit", or "an indoor heating unit" which blows warm air against "a bottom" or the like of the user seating on the toilet seat to dry.

In the specification of the application, each of "upward", "downward", "forward", "backward", "left lateral", and "right lateral" is a direction viewed from the user sitting on the toilet seat 30 with the back to the open toilet lid 50.

Figure 2A:
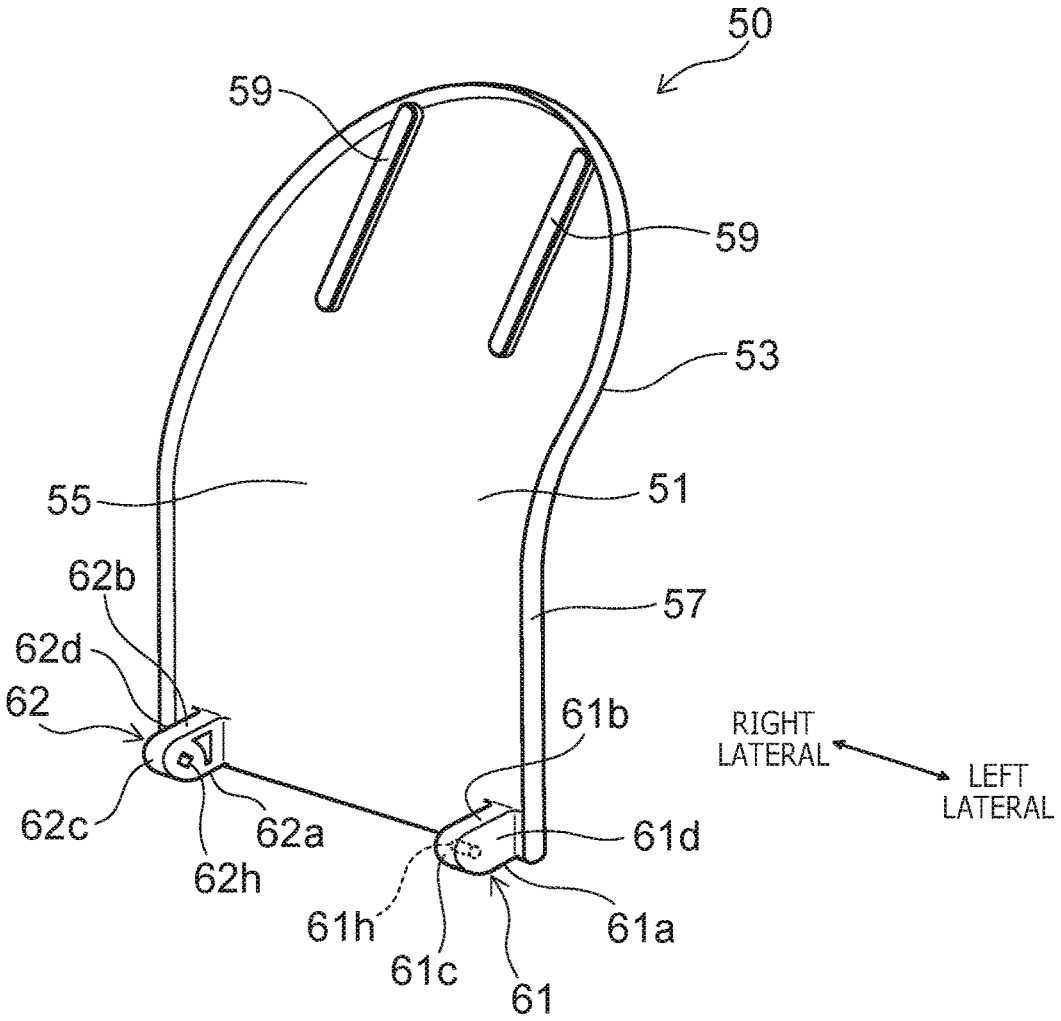
FIG. 2A and FIG. 2B are a perspective view and a side view illustrating a toilet lid of the toilet lid device according to the embodiment.
Figure 2B:
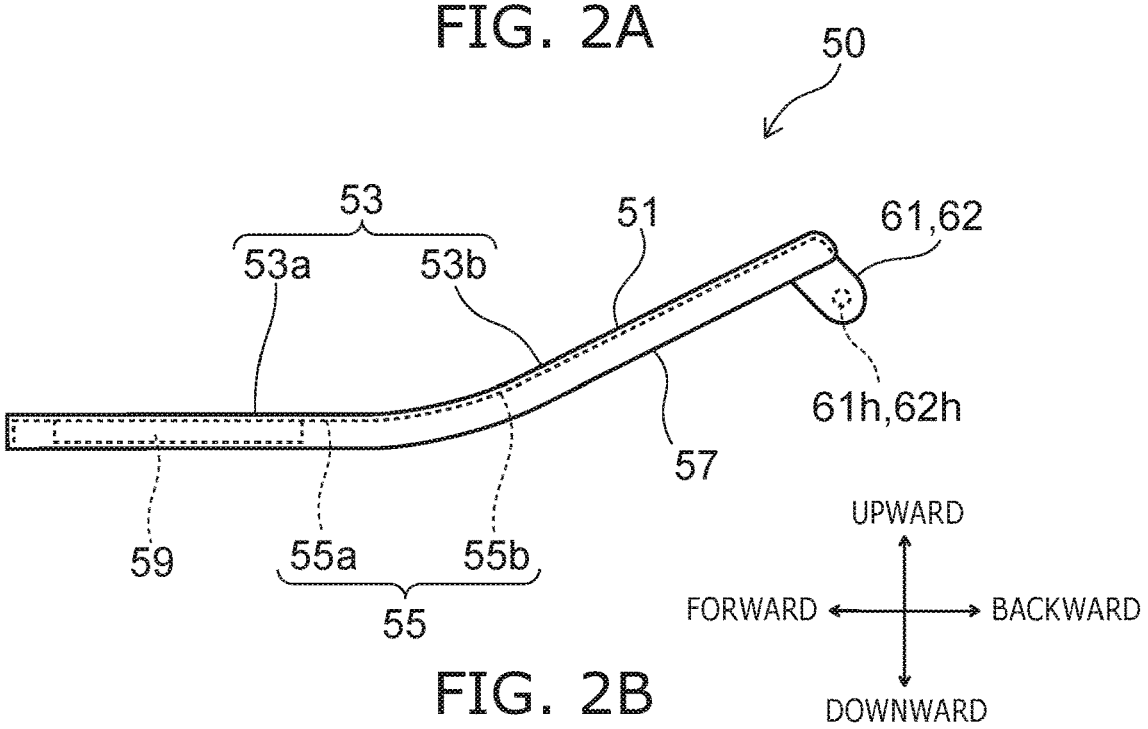

FIG. 2A and FIG. 2B are a perspective view and a side view illustrating a toilet lid of the toilet lid device according to the embodiment.

FIG. 2B shows a state of the toilet lid 50 in a closed state viewed in the left lateral direction.

The toilet lid 50 is formed from, for example, a urea resin. The toilet lid 50 is, for example, symmetrical, and has a bent shape when viewed in the lateral direction. A main body of the toilet lid 50 is a bent single plate bending plate portion 51. An edge portion 57 is provided on a periphery of the bending plate portion 51. As shown in FIG. 2B, the toilet lid 50 (a bending plate portion 51) has an upper surface 53, and a lower surface 55 on an opposite side to the upper surface 53. The upper surface 53 faces upward and the lower surface 55 faces downward in a state of the toilet lid 50 closed. That is, the lower surface 55 is a surface facing an upper surface of the casing 10 and the toilet seat 30. The edge portion 57 has a shape protruding in a direction from the upper surface 53 toward the lower surface 55 in the periphery of the bending plate portion 51.

As shown in FIG. 2B, the lower surface 55 has a first lower surface 55*a* and a second lower surface 55*b*. The first lower surface 55*a* is positioned on the forward side of the toilet lid 50, and the second lower surface 55*b* is positioned on the backward side of the first lower surface 55*a* in the state of the toilet lid 50 closed. An extending direction of the second lower surface 55*b* crosses an extending direction of the first lower surface 55*a* when viewed in the lateral direction in correspondence to the bent shape of the bending plate portion 51. For example, the first lower surface 55*a* is a portion extending generally in a horizontal direction, and the second lower surface 55*b* is a portion having a downward slope facing forward in the state of the toilet lid 50 closed.

Similarly, the upper surface 53 has a first upper surface 53*a* and a second upper surface 53*b*. The first upper surface 53*a* is on the forward side and the second upper surface 53*b* is connected to the backward side in the state of the toilet lid 50 closed. The upper surface 53 of the toilet lid 50 is parallel to the lower surface 55 of the toilet lid 50. More specifically, the first upper surface 53*a* is parallel to the first lower surface 55*a* and the second upper surface 53*b* is parallel to the second lower surface 55*b*.

The toilet lid 50 includes a pair of hinge portions (a first hinge portion 61 and a second hinge portion 62) arranged in a left-right direction. The pair of hinge portions are positioned at a rear end of the toilet lid 50, and provided on the second lower surface 55*b* in the state of the toilet lid 50 closed. The pair of hinge portions have a shape protruding in a direction from the upper surface 53 toward the lower surface 55. The first hinge portion 61 is positioned near a left end of the toilet lid 50, and the second hinge portion 62 is positioned near a right end of the toilet lid 50. The pair of hinge portions are inside the left and right ends of the toilet lid 50 and are separated from the left and right ends of the toilet lid 50.

The first hinge portion 61 and the second hinge portion 62 have a hole 61*h* and a hole 62*h* extending in the left-right direction, respectively. The holes 61*h*, 62*h* are engaged with a support portion described later. Thereby, the toilet lid 50 is rotatably pivoted at the first hinge portion 61 and the second hinge portion 62.

Two abutment portions 59 are provided on the first lower surface 55*a*. The abutment portions 59 are in abutment with the upper surface of the toilet seat 30 in the state of the toilet lid 50 closed. That is, the toilet lid 50 is supported at the pair of hinge portions and the abutment portions 59 in the state of the toilet lid 50 closed. A thickness (a height) of the abutment portions 59 is thinner than a thickness of the toilet lid 50. For that reason, as shown in FIG. 2B, the abutment portions 59 are not viewed when viewed in the lateral direction.

FIG. 3A to FIG. 3D are a rear view, a plan view, a right side view, and a left side view, respectively, illustrating the casing of the toilet lid device according to the embodiment.

Figure 3A:
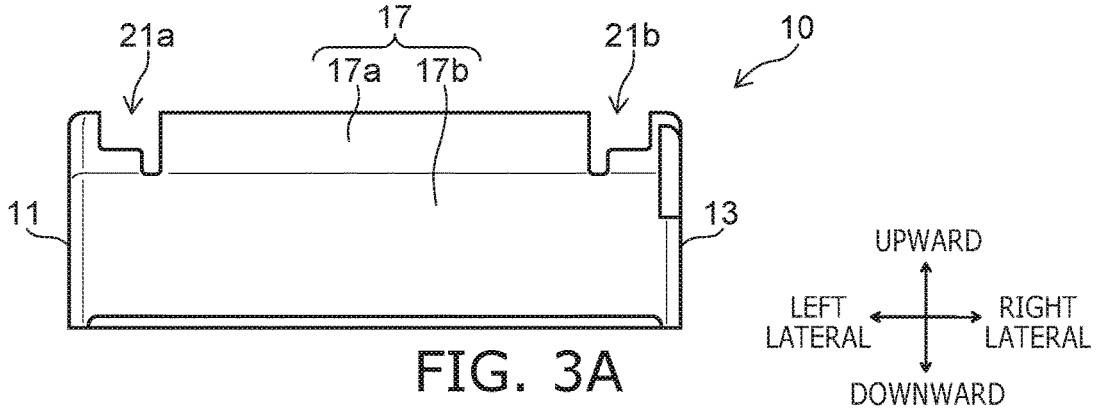
FIG. 3A to FIG. 3D are a rear view, a plan view, a right side view, and a left side view, respectively, illustrating a casing of the toilet lid device according to the embodiment.
Figure 3B:
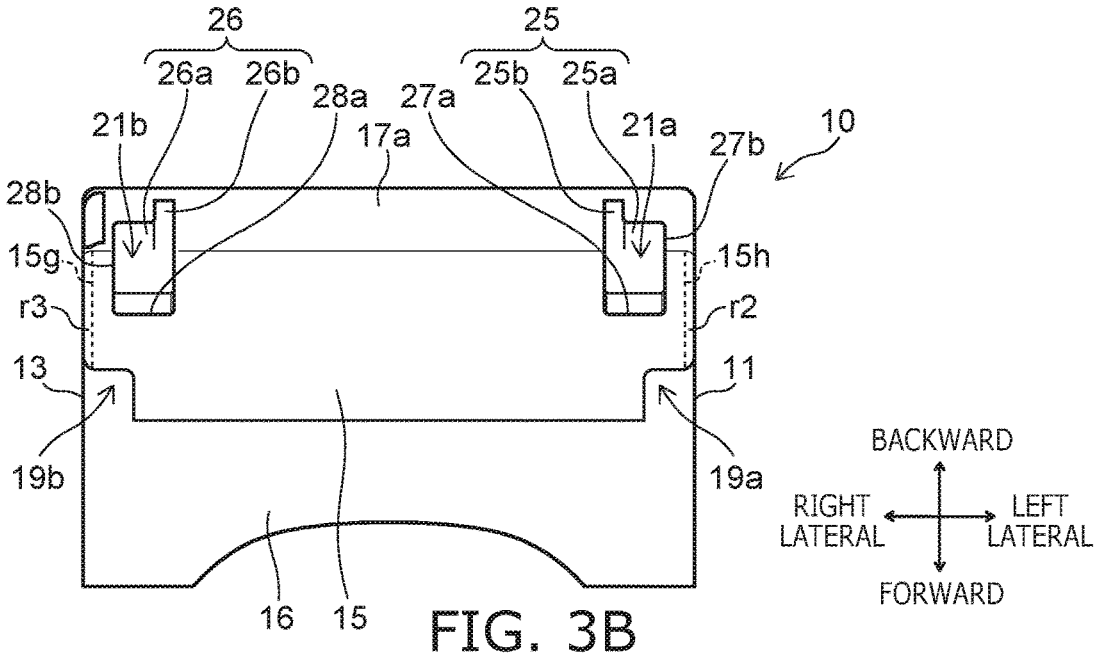
Figure 3C:
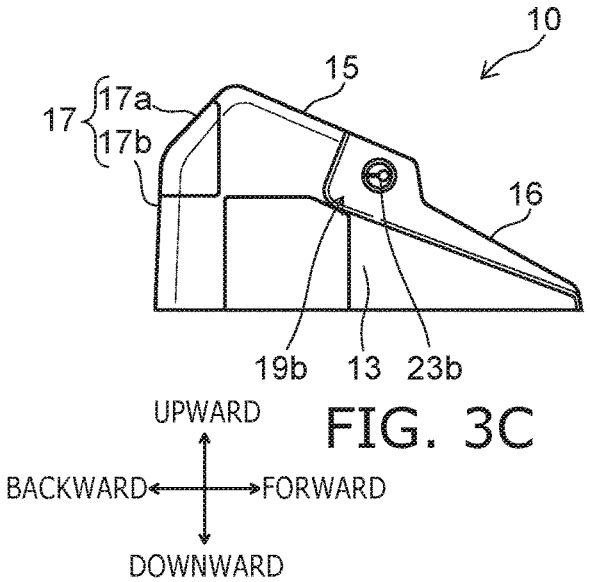
Figure 3D:
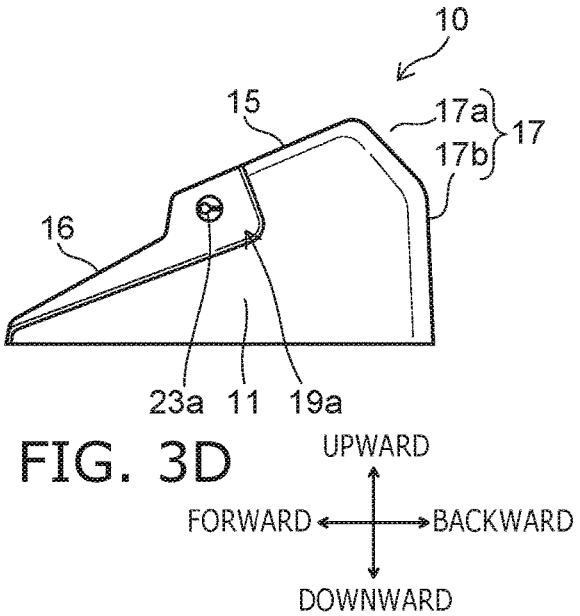

FIG. 3A shows a state of the casing 10 viewed in the backward direction, FIG. 3B shows a state of the casing 10 viewed in the upward direction, FIG. 3C shows a state of the casing 10 in the right lateral direction, and FIG. 3D shows a state of the casing 10 viewed in the left lateral direction. The casing 10 is formed from, for example, a resin of poly propylene or the like. The casing 10 has a left side surface 11, a right side surface 13, an upper surface 15, a toilet seat disposition surface 16, and a rear surface 17.

The upper surface 15 is a surface facing upward and not facing backward. In this example, the upper surface 15 is an inclined surface facing upward and forward. The toilet seat disposition surface 16 is provided forward the upper surface 15, and is a surface where a rear portion of the toilet seat 30 in the closed state is disposed. That is, the rear portion of the toilet seat 30 is positioned right above the toilet seat disposition surface 16 along the toilet seat disposition surface 16 in the state of the toilet seat 30 closed. A step is formed between the upper surface 15 and the toilet seat disposition surface 16, and the position of the toilet seat disposition surface 16 is low. The toilet seat disposition surface 16 is an inclined surface facing upward and forward. The upper surface 15 of the casing 10 is taken as a region where the toilet seat 30 in the closed state is not disposed. That is, the upper surface 15 is the region which is positioned upward the toilet seat disposition surface 16 and the step between the toilet seat disposition surface and the upper surface 15.

A first step portion 19*a* and a second step portion 19*b* are provided on a right end and a left end of the casing 10 between the upper surface 10 and the toilet seat disposition surface 16. The first step portion 19*a* is a retreated portion of the left end of the upper surface 15, and is exposed to the left lateral of the casing 10 as shown in FIG. 3D. The second step portion 19*b* is a retreated portion of the right end of the upper surface 15, and is exposed to the right lateral of the casing 10 as shown in FIG. 3C.

A left rear end 32 (see FIG. 1) of the toilet seat 30 is disposed on the step portion 19*a*, and is supported by a support shaft 23*a* (see FIG. 3D) provided in the casing 10. A right rear end 31 (see FIG. 1) of the toilet seat 30 is disposed on the second step portion 19*b*, and is supported by a support shaft 23*b* (see FIG. 3D) provided in the casing 10. Thereby, the toilet seat 30 is rotatably pivoted.

The rear surface 17 is a surface facing backward. The rear surface 17 may be an inclined surface facing backward and upward. In this example, the rear surface 17 has a first rear surface 17*a* facing backward and upward and a second rear surface 17*b* extending downward from the first rear surface 17*a*.

A pair of grooves (a first groove 21*a* and a second groove 21*b*) arranged in the left-right direction are provided in the casing 10. The first groove 21*a* and the second grove 21*b* are portions of the upper surface 15 and the first rear surface 17*a*, which are depressed downward. The first groove 21*a* and the second groove 21*b* are provided between the left side surface 11 and the right side surface 13, and are separated from the left side surface 11 and the right side surface 13. In other words, the first groove 21*a* and the second groove 21*b* are disposed inside the left-right ends of the casing 10. That is, as shown in FIG. 3C, the first groove 21*a* and the second groove 21*b* are not exposed to the right lateral of the casing 10 and not viewed in the right lateral direction because of being covered with the right side surface 13. As shown in FIG. 3D, the first groove 21*a* and the second groove 21*b* are not exposed to the left lateral and not viewed in the left lateral direction because of being covered with the left side surface 11.

The first hinge portion 61 of the toilet lid 50 is disposed in the first groove 21*a*. The second hinge portion 62 of the toilet lid 50 is disposed in the second groove 21*b*.

FIG. 4 is a plan view illustrating a portion of the toilet lid device according to the embodiment.

FIG. 4 shows a state of the upper surface 15 of the casing 10 viewed in the upward direction in the state of the toilet seat 30 closed and the toilet lid 50 opened as shown in FIG. 1.

As shown in FIG. 4, the toilet lid device 100 includes a pair of support portions (a first support portion 71 and a second support portion 72) arranged in the left-right direction. The first support portion 71 and the second support portion 72 rotatably support the toilet lid 50 with respect to the casing 10.

At least a portion of the first support portion 71 is disposed in the first groove 21*a* of the casing 10. The first hinge portion 61 is connected to the first support portion 71 in the first groove 21*a*. At least a portion of the second support portion 72 is disposed in the second groove 21*b* of the casing 10. The second hinge portion 62 is connected to the second support portion 72 in the second groove 21*b*.

In this example, each of the first support portion 71 and the second support portion 72 is a shaft extending in the left-right direction, and protrudes from the inside of the casing 10. The first hinge portion 71 is inserted into the hole 61*h* of the first hinge portion 61 described with respect to FIG. 2A, and is engaged with the first hinge portion 61. The second support portion 72 is inserted into the hole 62*h* of the second hinge portion 62, and is engaged with the second hinge portion 62. Thereby, the toilet lid 50 rotates (open/close) with rotation of the first support portion 71 and the second support portion 72.

A buffer unit 80 housed in the casing 10 is provided in the first support portion 71. The buffer unit 80 includes a shaft connected to the first support portion 71 and fluid (oil) or the like filled around the shaft therein, and functions as a dumper. A viscous force of the fluid is transferred to the toilet lid 50 via the first support portion 71. Thereby, the buffer unit 80 operates a braking force in a reverse direction opposite to a closing direction of the toilet lid 50 on the toilet lid 50 by the viscous force when the toiled lid 50 is closed.

An assist unit 90 housed in the casing 10 is provided in the second support portion 72. The assist unit 90 includes a shaft connected to the second support portion 72 and an elastic body (for example, coil spring) engaged with the shaft or the like therein. An elastic force of the elastic body is transferred to the toilet lid 50 via the second support portion 72. Thereby, the assist unit 90 operates an urging force in opening direction on the toilet lid 50 by the elastic force when the toilet lid 50 is closed. The assist unit 90 urges the toilet lid 50 only in the opening direction of the toilet lid 50. The buffer unit 80 also may be provided with the elastic body urging the toilet lid 50 in the opening direction of the toilet lid 50.

As described above, the first groove 21*a* and the second groove 21*b* are disposed inside the left-right ends of the casing 10. For that reason, each of the left side surface 11 and the right side surface 13 of the casing 10 does not include a step backward the rear end of the toilet seat 30. More specifically, the left side surface 11 does not have the step backward the left rear end 32 of the closed toilet seat 30. The right side surface 13 does not include a step backward the right rear end 31 of the closed toilet seat 30.

Thereby, sanitary property of the left side surface 11 and the right side surface 13 of the casing 10 can be improved. For example, the dust can be suppressed from accumulating on the left side surface 11 and the right side surface 13 of the casing 10. For example, wiping cleaning of the left side surface 11 and the right side surface 13 of the casing 10 becomes easy. Since the toilet lid 50 is supported at the first, second hinge portions 61, 62, balance in the left-right direction can be improved in comparison with the case of single hinge portion. For example, the toilet lid 50 is hard to be twisted when the user holds the right rear end or the left rear end of the toilet lid 50 and rotates the toilet lid.

In the specification of the application, it is assumed that "not including a step" includes not only the case of strictly no step but also, for example, the state of no step larger than 3 mm, favorably 1 mm. For example, the side surface of the casing 10 may be formed of multiple members like the right side surface 13 shown in FIG. 3C. At this time, surfaces of the multiple members are provided so as to be flush with each other on the side surface of the casing 10. The fact that the two surfaces are "flush with" means that a distance between the two surfaces is not less than 0 mm and not more than 3 mm. That is, "be flush with" may include not only strictly no step or gap between the two surfaces but also the case of existing a slight step or gap.

For example, in the case where a twist force of the toilet lid is applied to the other hinge portion in a state where one hinge of the pair of hinges provided on the toilet lid 50 is fixed, if a distance between the hinge portions is long, there is a fear that the toilet lid is easy to be twisted and the toilet lid is damaged. On the contrary, in the embodiment, each of the first hinge portion 61 and the second hinge portion 62 is disposed at a position separated from the left side surface 11 and the right side surface 13 of the casing 10 between the left side surface 11 (left end) and the right sider surface 13 (right end) of the casing 10. Thereby, in comparison with the case where the first hinge portion 61 and the second hinge portion 62 are provided on the left side surface 11 and the right side surface 13 of the casing 10, the distance between the hinge portions can be shorten. Thereby, the damage due to the twist of the toilet lid 50 between the hinge portions can be suppressed.

Figure 5A:
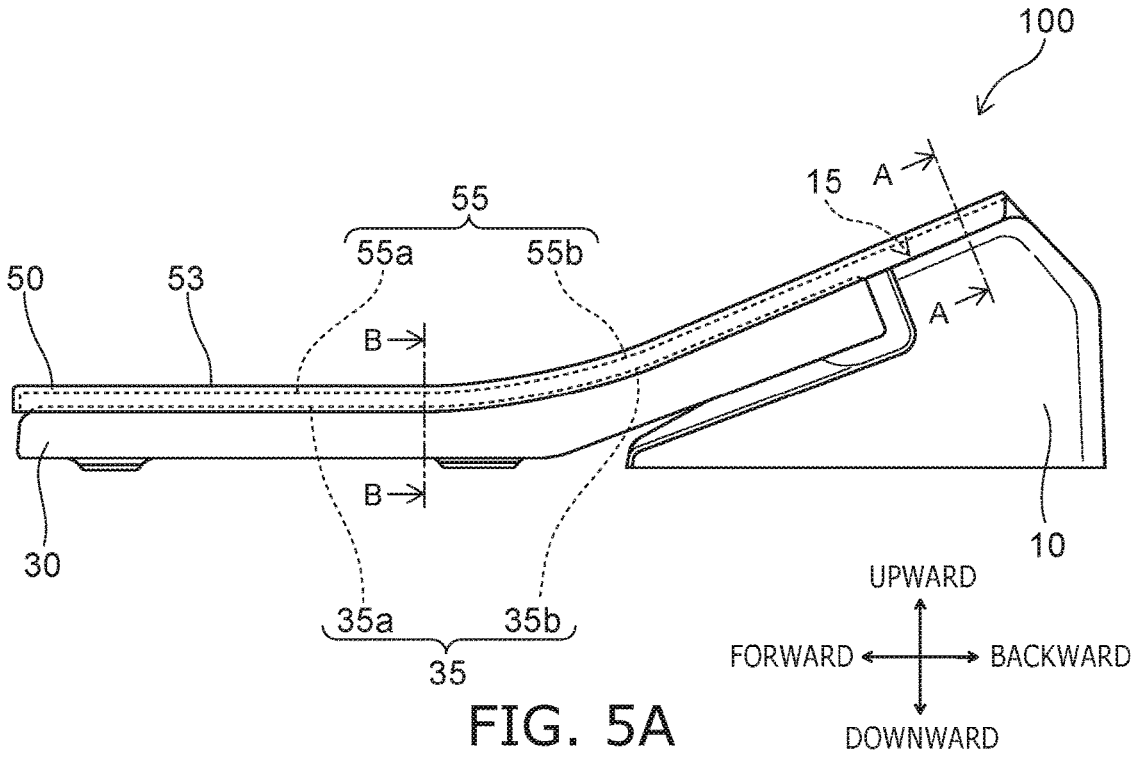
FIG. 5A and FIG. 5B are a side view and a cross sectional view illustrating the toilet lid device according to the embodiment.
Figure 5B:
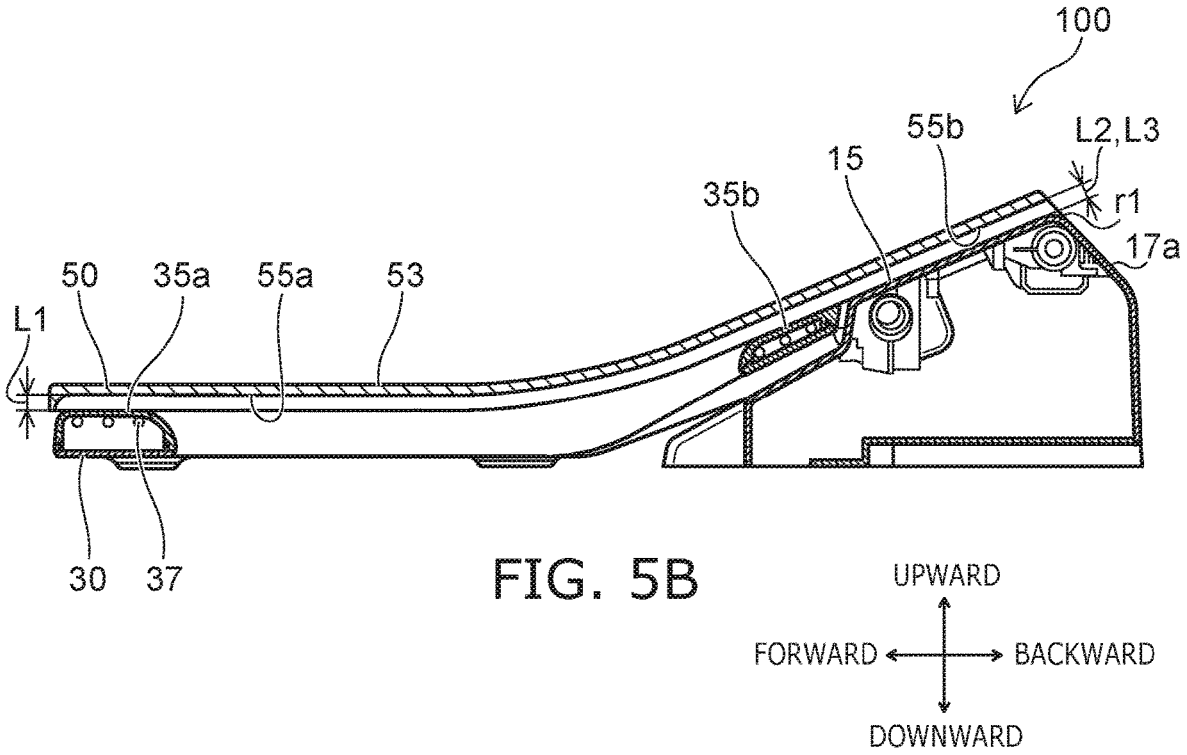

FIG. 5A and FIG. 5B are a side view and a cross sectional view illustrating the toilet lid device according to the embodiment.

FIG. 5A shows a state of the toilet device 100 in the state of the toilet seat 30 closed and the toilet lid 50 closed viewed in the left lateral direction. FIG. 5B is a cross sectional view of FIG. 5A, and shows a cross section passing through the center in the left-right direction of the toilet lid device 100 and perpendicular to the left-right direction.

The toilet seat 30 is formed from a resin such as polypropylene, for example. The toilet seat 30 has an upper surface 35 facing the closed toilet lid 50. The toilet seat 30 has a bent shape when viewed in the lateral direction as well as the toilet lid 50. That is, the upper surface 35 of the toilet seat 30 has an upper surface 35*a* on the forward side and an upper surface 35*b* on the backward side, and an extending direction of the upper surface 35*b* when viewed in the lateral direction crosses an extending direction of the upper surface 35*a*.

As shown in FIG. 5A, the lower surface 55 of the toilet lid 50 covers the upper surface 35 of the toilet seat 30 and the upper surface 15 of the casing 10 from upward. More specifically, the first lower surface 55*a* of the toilet lid 50 covers the upper surface 35*a* of the toilet seat 30 from upward, the second lower surface 55*b* of the toilet lid 50 covers the upper surface 35*b* of the toilet seat 30 and the upper surface 15 of the casing 10 from upward.

The first lower surface 55*a* of the toilet lid 50 is parallel to the upper surface 35*a* of the toilet seat 30 in the state of the toilet lid 50 closed. The second lower surface 55*b* of the toilet lid 50 is parallel to the upper surface 15 of the casing 10 on the backward side of the toilet seat 30 in the state of the toilet lid 50 closed.

Thereby, the lower surface 55 of the toilet lid 50 can be uniformly closer to the upper surface 35 of the toilet seat 30, and the lower surface 55 of the toilet lid 50 can be uniformly close to the upper surface 15 of the casing 10. For that reason, even if the closed toilet lid 50 is deflected at any position, the lower surface 55 of the toilet lid 50 immediately abuts with the upper surface 35 of the toilet seat 30 or the upper surface 15 of the casing 10, and the toilet lid 50 is supported from downward. That is, a load applied to the closed toilet lid 50 over the entire upper surface 35 of the toilet seat 30 and the upper surface 15 of the casing 10 is easy to be supported and the damage of the toilet lid 50 due to the deflection can be suppressed.

In the specification of the application, "parallel" includes not only strictly parallel but also generally parallel. That is, "parallel" includes not only the case where the distance between two surfaces is constant but also the case where the distance between two surfaces changes, for example, in a range of 5 millimeters (mm) or less.

For example, a distance L1 between the upper surface 35*a* of the toilet seat 30 and the first lower surface 55*a* of the toilet lid 50 in a direction perpendicular to the upper surface 35*a* of the toilet seat 30 is not less than 5 mm and not more than 10 mm. For example, a distance L2 between the upper surface 15 of the casing 10 and the second lower surface 55*b* of the toilet lid 50 is not less than 5 mm and not more than 10 mm.

As shown in FIG. 5B, the second lower surface 55*b* of the toilet lid 50 is parallel to the upper surface 35*b* of the toilet seat 30 in the state of the toilet lid 50 closed. For example, a distance L3 between the upper surface 35*b* of the toilet seat 30 and the second lower surface 55*b* of the toilet lid 50 along a direction perpendicular to the upper surface 35*b* of the toilet seat 30 is not less than 5 mm and not more than 10 mm. The distance L1, the distance L2, the distance L3 are desired to be equal one another.

In the case where the first lower surface 55*a* of the toilet lid 50 is parallel to the upper surface 35*a* of the toilet seat 30 and the second lower surface 55*b* of the toilet lid 50 is parallel to the upper surface 15 of the casing 10, if the upper surface 53 of the toilet lid 50 is not parallel to the lower surface 55 of the toilet lid 50, a thickness and a weight of the toilet lid 50 increase, and there is a fear that opening and closing operation of the toilet lid 50 becomes uneasy and usability for the user becomes bad, and the toilet lid 50 becomes difficult to be formed. On the contrary, as described with respect to FIG. 2, in the embodiment, the upper surface 53 of the toilet lid 50 is parallel to the lower surface 55 of the toilet lid 50. Thereby, the toilet lid 50 can be thin, the uneasiness of the opening and closing operation of the toilet lid 50 can be suppressed, and the usability for the user can be suppressed from becoming bad. Formability of the toilet lid 50 can be suppressed from decreasing.

In the case where the lower surface 55 of the toilet lid 50 is parallel to each of the upper surface 35 of the toilet seat 30 and the upper surface 15 of the casing 10, if there is a step between the upper surface 35 of the toilet seat 30 and the upper surface 15 of the casing 10, it results in formation of the step on the lower surface 55 of the toilet lid 50 as well. In this case, the shape of the toilet lid 50 becomes complex, and manufacturing may be difficult. The step is formed also on the upper surface 53 of the toilet lid 50 and cleanliness may deteriorate. On the contrary, in the embodiment, as shown in FIG. 5A and FIG. 5B, the upper surface 35 (the upper surface 35*b*) of the toilet seat 30 is flush with the upper surface 15 of the casing 10. Thereby, since unevenness between the upper surface 35 of the toilet seat 30 and the upper surface 15 of the casing 10 is small, it can be suppressed that the shape of the toilet lid 50 becomes complex and the cleanliness deteriorates due to the step.

The toilet lid 50 covers the entire upper surface 15 of the casing 10 in the state of the toilet lid 50 closed. In other words, the lower surface 55 of the toilet lid 50 faces the entire upper surface 15 of the casing 10. Thereby, the dust can be suppressed from accumulating on the casing 10. Also, the dust can also be suppressed from accumulating between the toilet seat 30 and the casing 10. As shown in FIG. 5B, a curved surface r1 is provided between the upper surface 15 and the first rear surface 17*a* of the casing 10 in a cross section perpendicular to the left-right direction. The upper surface 15 does not include the curved surface r1, and for example, is a portion extending linearly.

As shown in FIG. 5B, a toilet seat heater 37 is provided inside the toilet seat 30. The toilet seat heater 37 includes, for example, a circular metal member provided along the circumference of the opening of the toilet seat 30. The metal member of the toilet seat heater 37 is energized, and thus the toilet seat heater 37 warms the upper surface 35 of the toilet seat 30. The toilet seat heater 37 may be based on, for example, a tubing heater, a sheathed heater, a halogen heater, a carbon heater or the like. The metal member is formed of, for example, aluminum, copper or the like. The shape of the metal member may be in various configurations such as a sheet configuration, a wire configuration, a mesh configuration or the like.

The heat of the toilet seat heater 37 is easy to escape to the outside from a long distance portion between the upper surface 35 of the toilet seat 30 and the lower surface 55 of the toilet lid 50 in the state of the toilet lid 50 closed. On the contrary, since the first lower surface 55*a* of the toilet lid 50 is parallel to the upper surface 35*a* of the toilet seat 30, the long distance portion between the upper surface 35 of the toilet seat 30 and the lower surface of the toilet lid 50 can be suppressed from being generated. Thereby, the warm air of the toilet seat heater 37 can be suppressed from escaping to the outside from the long distance portion between the upper surface 35 of the toilet seat 30 and the lower surface of the toilet lid 50.

Figure 6:
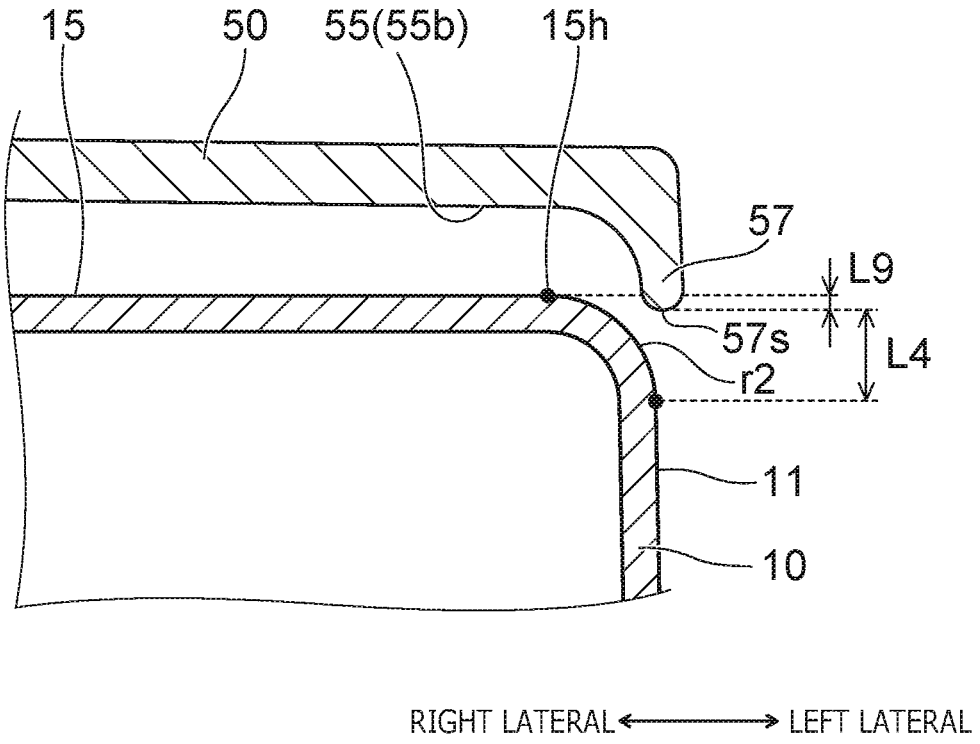
FIG. 6 is a cross sectional view illustrating a portion of the toilet lid device according to the embodiment.

FIG. 6 is a cross sectional view illustrating a portion of the toilet lid device according to the embodiment.

FIG. 6 shows the vicinity of the left end of the casing 10 and the toilet lid 50 in A-A cross section shown in FIG. 5A.

A curved surface r2 is provided between the upper surface 15 and the left side surface 11 of the casing 10. Each of the upper surface 15 and the left side surface 11 does not include the curve surface r2, and is a portion extending linearly in the cross section perpendicular to a longitudinal direction.

A left end portion (the edge portion 57) of the toilet lid 50 extends to the outside (left side) from the left side surface 11 of the casing 10. A lower end 57*s* of the edge portion 57 extends downward the upper surface 15. A distance L9 in a vertical direction between the lower end 57*s* of the edge portion 57 and the upper surface 15 is, for example, approximately not less than 1 mm and not more than 5 mm.

The toilet lid 50 covers a portion of the curved surface r2. That is, the portion of the edge portion 57 overlaps the portion of the curved surface r2 in the left-right direction. On the other hand, the toilet lid 50 does not cover the left side surface 11 of the casing 10. That is, the edge portion 57 does not overlap the left side surface 11 in the left-right direction. A distance L4 in the longitudinal direction between the lower end 57*s* of the edge portion 57 and the left side surface 11 is, for example, approximately not less than 6 mm and not more than 10 mm.

It is much the same as the above for right ends of the toilet lid 50 and the casing 10. That is, a curved surface r3 is provided between the upper surface 15 and the right side surface 13 of the casing 10 (see FIG. 3B). Each of the upper surface 15 and the right side surface 13 does not include the curved surface r3, and is a portion extending linearly in the cross section perpendicular to a longitudinal direction. A right end portion of the toilet lid 50 extends to the outside (right side) from the right side surface 13 of the casing 10. A portion of the edge portion 57 overlaps a portion of the curved surface r3 in the left-right direction in the state of the toilet lid 50 closed. On the other hand, the edge portion 57 does not overlap the right side surface 13 in the left-right direction in the state of the toilet lid 50 closed.

In this way, the toilet lid 50 exposes the left side surface 11 and the right side surface 13 of the casing 10 in the state of the toilet lid 50 closed. Thereby, the left side surface 11 and the right side surface 13 of the casing 10 are easy to be cleaned with the toilet lid 50 closed. Since the toilet lid 50 covers the upper surface 15 of the casing 10 from a right side end 15*g* (see FIG. 3B) to a left side end 15*h* in the state of the toilet lid 50 closed, the dust can be suppressed from accumulating on the upper surface 15 of the casing 10.

Figure 7:
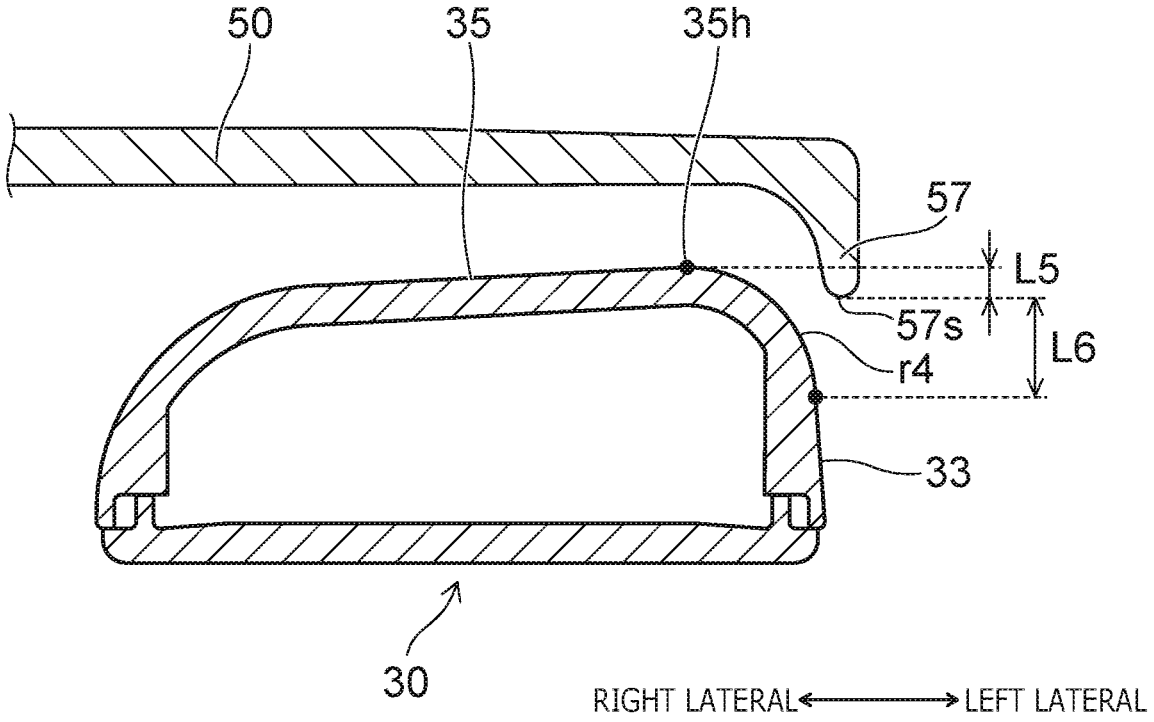
FIG. 7 is a cross sectional view illustrating a portion of the toilet lid device according to the embodiment.

FIG. 7 is a cross sectional view illustrating a portion of the toilet lid device according to the embodiment.

FIG. 7 shows the vicinity of the left end of the toilet seat 30 and the toilet lid 50 in B-B cross section shown FIG. 5A.

A curved surface r4 is provided between the upper surface 35 and a left side surface 33 of the toilet seat 30. Each of the upper surface 35 and the left side surface 33 does not include the curved surface r4, and is a portion extending linearly in the cross section perpendicular to the longitudinal direction.

The left end portion (the edge portion 57) of the toilet lid 50 extends to the outside (left side) from the left side surface 33 of the toilet seat 30. The lower end 57*s* of the edge portion 57 extends downward the upper surface 35. A distance L5 in the vertical direction between the lower end 57*s* of the edge portion 57 and the upper surface 15 is, for example, approximately not less than 1 mm and not more than 5 mm.

The toilet lid 50 covers a portion of the curved surface r4. That is, a portion of the edge portion 57 overlaps the portion of the curved surface r4 in the left-right direction. On the other hand, the toilet lid 50 does not cover the left side surface 33 of the toilet seat 30. That is, the edge portion 57 does not overlap the left side surface 33 in the left-right direction. A distance L6 in the vertical direction between the lower end 57*s* of the edge portion 57 and the left side surface 33 is, for example, not less than 6 mm and not more than 10 mm.

It is much the same as the above for the right ends of the toilet seat 30 and the toilet lid 50. That is, a curved surface r5 is provided (see FIG. 1) between the upper surface 35 and the right side surface 34 of the toilet seat 30. Each of the upper surface 35 and the right side surface 34 does not include the curved surface r5, and is a portion extending linearly in the cross section perpendicular to the longitudinal direction. The right end portion of the toilet lid 50 extends to the outside (right side) from the right side surface 34 of the toilet seat 30. A portion of the edge portion 57 overlaps a portion of the curved surface r5 in the left-right direction in the state of the toilet lid 50 closed. On the other hand, the edge portion 57 does not overlap the right side surface 34 in the left-right direction in the state of the toilet lid 50 closed.

In this way, the toilet lid 50 exposes the left side surface 33 and the right side surface 34 of the toilet seat 30 in the state of the toilet lid 50 closed. For example, the toilet lid 50 is thinner than the toilet seat 30 when viewed in the lateral direction. Also, the toilet lid 50 covers the upper surface 35 of the toilet seat 30 from a right side end 35*g* (see FIG. 1) to a left side end 35*h* in the state of the toilet lid 50 closed.

If a lateral width of the toilet seat 30 is smaller than the casing 10, a range of the casing 10 covered with the toilet seat 30 from upward becomes narrow. For that reason, for example, left-right end portions of the toilet seat disposition surface 16 of the casing 10 are exposed, and the dust may be easy to be accumulated on the exposed portion in the state of the toilet lid 50 opened. On the contrary, in the embodiment, the toilet lid 50 does not cover the left side surface 33 and the right side surface 34 of the toilet seat 30 in the state of the toilet lid 50 closed, and exposes the left side surface 33 and the right side surface 34 of the toilet seat 30. Thereby, the lateral width of the toilet seat 30 can be large. Therefore, the range of the casing covered with the toilet seat 30 from upward can be broad, and the dust can be suppressed from accumulating on the casing 10. The dust can also be suppressed from accumulating between the toilet seat 30 and the casing 10.

If the left side surface 33 and the right side surface 34 of the toilet seat 30 are exposed in the state of the toilet lid 50 closed, there is a fear that the heat of the toilet seat heater 37 is easy to escape to the outside from the exposed left side surface 33 and the right side surface 34. On the contrary, if the first lower surface 55*a* of the toilet lid 50 is parallel to the upper surface 35*a* of the toilet seat 30, the entire first lower surface 55*a* of the toilet lid 50 can be uniformly close to the toilet seat 30. Thereby, the heat of the toilet seat heater 37 can be suppressed from escaping to the outside. Also, if the second lower surface 55*b* of the toilet lid 50 is parallel to the upper surface 35*b* of the toilet seat 30, the entire second lower surface 55*b* of the toilet lid 50 can be uniformly close to the toilet seat 30. Furthermore, the heat can be suppressed from escaping.

Figure 8:
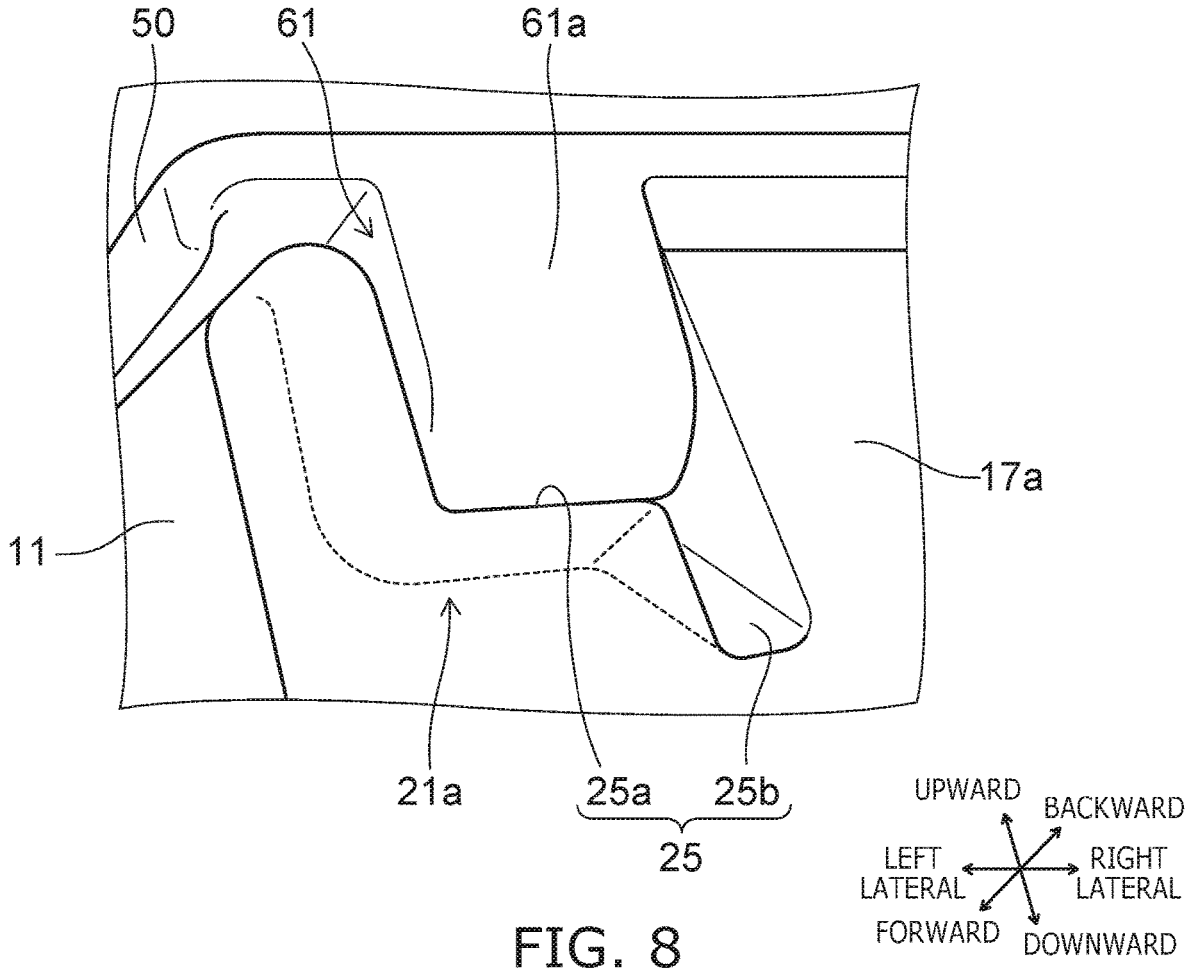
FIG. 8 is a perspective view illustrating the toilet lid device according to the embodiment.

FIG. 8 is a perspective view illustrating a portion of the toilet lid device according to the embodiment.

FIG. 8 shows a state of periphery of the first hinge portion 61 viewed in the backward direction in the state of the toilet lid 50 closed.

A restriction portion 25*a* and a recess 25*b* are provided on a lower surface 25 of the first groove 21*a*. The restriction portion 25*a* is positioned outside the casing 10 from the recess 25*b*. In other words, the restriction portion 25*a* is positioned between the left side surface 11 and the recess 25*b* in the left-right direction. The first hinge portion 61 has an abutment surface 61*a* exposed backward the casing 10 in the state of the toilet lid 50 closed.

The first hinge portion 61 is disposed upward the restriction portion 25*a*, and is not disposed in the recess 25*b*. The recess 25*b* is exposed on a side of the rear surface 17 of the casing 10, and communicates with the inside of the first groove 21*a*. Thereby, the inside of the first groove 21*a* can be cleaned from the recess 25*b*, and the cleanliness can be improved.

A bottom surface of the recess 25*b* has a downward slope toward backward. Thereby, water which enters into the first groove 21*a* can be discharged from the recess 25*b* to the outside.

Figure 9:
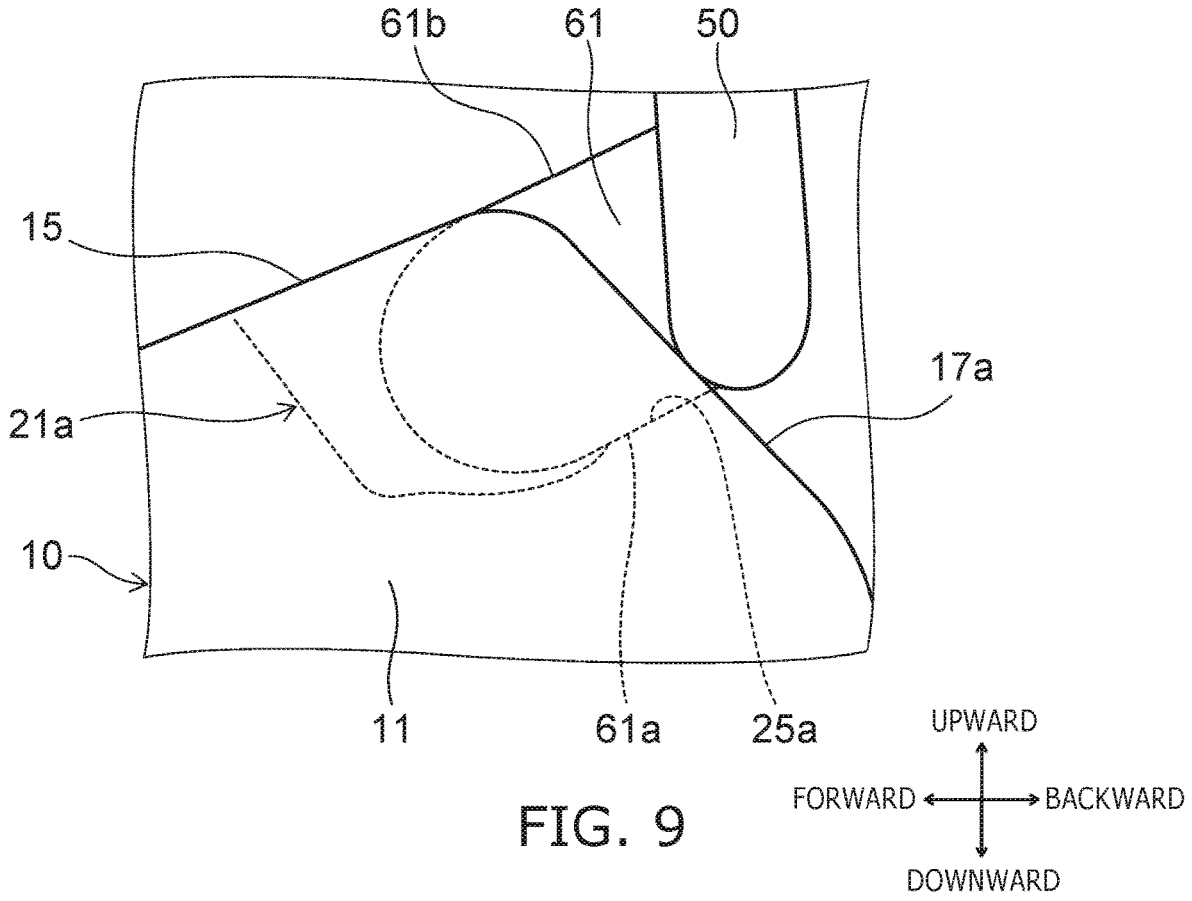
FIG. 9 is a side view illustrating a portion of the toilet lid device according to the embodiment.

FIG. 9 is a side view illustrating a portion of the toilet lid device according to the embodiment.

FIG. 9 shows a state of a periphery of the first hinge portion 61 viewed in the left lateral direction in the state of the toilet lid 50 opened.

If the toilet lid 50 rotates in the opening direction, the abutment surface 61*a* of the first hinge portion 61 also rotates. The rotated abutment surface 61*a* abuts with the restriction portion 25*a* of the first groove 21*a*. In this way, the restriction portion 25*a* restricts a movable range in the opening direction of the toilet lid 50.

The first hinge portion 61 has an upper surface 61*b* facing upward in the state of the toilet lid 50 opened. The upper surface 61*b* is flush with the upper surface 15 of the casing 10 in the state of the toilet lid 50 opened (the state in which the abutment surface 61*a* abuts with the restriction portion 25*a*). Thereby, since the unevenness between the upper surface 61*b* of the first hinge portion 61 and the upper surface 15 of the casing 10 is small, the cleanliness can be improved. For example, the wiping cleaning of the upper surface 15 of the casing 10 becomes easy.

Figure 10:
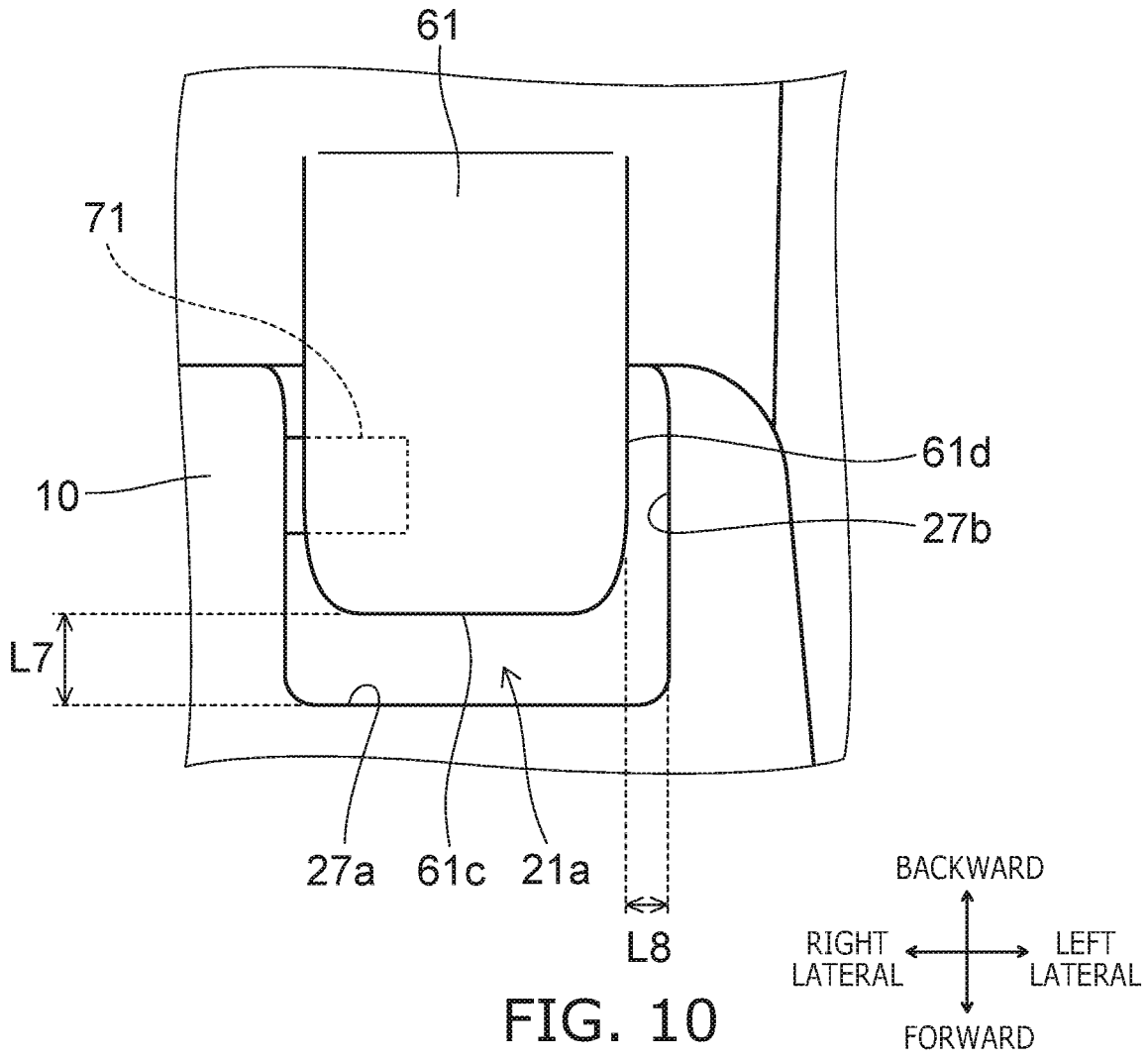
FIG. 10 is a plan view illustrating a portion of the toilet lid device according to the embodiment.

FIG. 10 is a plan view illustrating a portion of the toilet lid device according to the embodiment.

FIG. 10 shows a state of the periphery of the first hinge portion 61 viewed in the upward direction in the state of the toilet lid 50 opened.

A distance L7 is a distance between a forward end 61*c* of the first hinge portion 61 and a forward end 27*a* of the first groove 21*a* in the state of the toilet lid 50 opened. A distance L8 is a distance between a lateral end 61*d* (left side end) of the first hinge portion 61 and a lateral end 27*b* (left side end) of the first groove 21*a* in the state of the toilet lid 50 opened. As shown in FIG. 10, the distance L7 is longer than the distance L8.

In this way, a gap between the forward end 61*c* of the first hinge portion 61 and the forward end 27*a* of the first groove 21*a* is relatively broad. Thereby, a dust cloth or the like can be put into from between the forward end 61*c* of the first hinge portion 61 and the forward end 27*a* of the first groove 21*a* in the state of the toilet lid 50 opened. For that reason, the cleaning inside the first groove 21*a* becomes easy.

In the case where the dust cloth or the like is put into the first groove 21*a* from a gap between the lateral end 61*d* of the first hinge portion 61 and the lateral end 27*b* of the first groove 21*a*, a force is applied to a front end side of the first support portion 71 (shaft), and the first support portion 71 may be damaged. On the contrary, if the dust cloth or the like is put into the first groove 21*a* from the gap between the forward end 61*c* of the first hinge portion 61 and the forward end 27*a* of the first groove 21*a*, the first support portion 71 can be suppressed from being damaged.

The descriptions about FIG. 8 to FIG. 10 can also be applied to the shapes of the second groove 21*b* and the second hinge portion 62. For example, the casing 10 is symmetrical with respect to the first groove 21*a* and the second groove 21*b*. Also, for example, the toilet lid 50 is symmetrical with respect to the first hinge portion 61 and the second hinge portion 62. That is, the second hinge portion 62 includes an abutment surface 62*a*, an upper surface 62*b*, a forward end 62*c*, and a lateral end 62*d* (right side end) (see FIG. 2A). These are the same as the abutment surface 61*a*, the upper surface 61*b*, the forward end 61*c*, and the lateral end 61*d* of the first hinge portion 61, respectively. The second groove 21*b* includes a restriction portion 26*a*, a recess 26*b*, a forward end 28*a*, and a lateral end 28*b* (right side end) (see FIG. 3B). These are the same as the restriction portion 25*a*, the recess 25*b*, the forward end 27*a*, and the lateral end 27*b* of the first groove 21*a*, respectively.

As shown in FIG. 3B, the restriction portions 25*a*, 26*a* are provided outside from the recesses 25*b*, 26*b* in the left and right grooves. In other words, the recesses 25*b*, 26*b* are provided between the restriction portion 25*a* and the restriction portion 26*a*. The left and right balance of the toilet lid 50 can be improved by supporting the toilet lid 50 by the restriction portions 25*a*, 26*a* provided outside in the state of the toilet lid 50 opened. For example, one position of the left end and the right end of the toilet lid 50 is uneasy to be shifted forward or backward from the other position.

Although the embodiments are described above with reference to the specific examples, the embodiments are not limited to these specific examples. That is, design modification appropriately made by a person skilled in the art in regard to the embodiments is within the scope of the embodiments to the extent that the features of the embodiments are included. The shape, the dimension, the material, the disposition, and the installation form or the like included in the toilet lid device are not limited to illustrations and can be changed appropriately.

The components included in the embodiments described above can be combined to the extent of technical feasibility and the combinations are included in the scope of the embodiments to the extent that the feature of the embodiments is included.

What is claimed is:

1. A toilet lid device, comprising:

a casing;

a toilet seat and a toilet lid rotatably supported with respect to the casing; and a first support portion and a second support portion rotatably supporting the toilet lid with respect to the casing, the casing including a front surface and a rear surface opposite to each other, a left side surface and a right side surface opposite to each other and each connected to the front surface and the rear surface, and a first groove and a second groove provided on the rear surface, the first groove and the second groove being provided between the left side surface and the right side surface of the casing, the first groove and the second groove being not exposed on the left side surface and the right side surface and being exposed on an upper surface of the casing connected to each of the left side surface and the right side surface, the toilet lid including a first hinge portion and a second hinge portion, the first hinge portion being connected to the first support portion in the first groove, the second hinge portion being connected to the second support portion in the second groove, the first groove and the second groove being opened at the rear surface of the casing, and not opened at the front surface of the casing, and in a state of the toilet lid opened, a distance between the forward end of the first hinge portion and a forward end of the first groove being longer than a distance between a lateral end of the first hinge portion and a lateral end of the first groove, wherein in a state of the toilet lid opened, an upper surface of the first hinge portion is flush with the upper surface of the casing.

2. The toilet lid device according to claim 1, wherein the toilet lid exposes the left side surface and the right side surface of the casing in a state of the toilet lid closed, and covers the upper surface of the casing from a right side end to a left side end.

3. The toilet lid device according to claim 1, wherein the toilet lid exposes a left side surface and a right side surface of the toilet seat in a state of the toilet lid closed, and covers an upper surface of the toilet seat from a right side end to a left end side.

4. The toilet lid device according to claim 1, wherein the toilet lid covers the entire upper surface of the casing in a state of the toilet lid closed.

5. A toilet lid device, comprising:

a casing;

a toilet seat and a toilet lid rotatably supported with respect to the casing; and a first support portion and a second support portion rotatably supporting the toilet lid with respect to the casing, the casing including a front surface and a rear surface opposite to each other, a left side surface and a right side surface opposite to each other and each connected to the front surface and the rear surface, and a first groove and a second groove provided on the rear surface, the first groove and the second groove being provided between the left side surface and the right side surface of the casing, the first groove and the second groove being not exposed on the left side surface and the right side surface and being exposed on an upper surface of the casing connected to each of the left side surface and the right side surface, the toilet lid including a first hinge portion and a second hinge portion, the first hinge portion being connected to the first support portion in the first groove, the second hinge portion being connected to the second support portion in the second groove, the first groove and the second groove being opened at the rear surface of the casing, and not opened at the front surface of the casing, and a recess exposing on a rear surface side of the casing being provided on a lower surface of the first groove, wherein in a state of the toilet lid opened, an upper surface of the first hinge portion is flush with the upper surface of the casing.

6. The toilet lid device according to claim 5, wherein the toilet lid exposes the left side surface and the right side surface of the casing in a state of the toilet lid closed, and covers the upper surface of the casing from a right side end to a left side end.

7. The toilet lid device according to claim 5, wherein the toilet lid exposes a left side surface and a right side surface of the toilet seat in a state of the toilet lid closed, and covers an upper surface of the toilet seat from a right side end to a left end side.

8. The toilet lid device according to claim 5, wherein the toilet lid covers the entire upper surface of the casing in a state of the toilet lid closed.

* * * * *